United States Patent [19]

Locke et al.

[11] 4,009,518

[45] Mar. 1, 1977

[54] ELECTRIC DRY SHAVER HAVING FLEXIBLE FOIL TYPE OUTER CUTTER

[75] Inventors: David R. Locke, Bridgeport; Edward Szymansky, Fairfield, both of Conn.

[73] Assignee: Sperry Rand Corporation, Bridgeport, Conn.

[22] Filed: June 4, 1975

[21] Appl. No.: 583,618

[52] U.S. Cl. ..... 30/43.92; 30/346.51

[51] Int. Cl.[2] ..... B26B 19/04

[58] Field of Search ..... 30/346.51, 346.61, 43.7, 30/43.8, 43.9, 43.91, 43.92; 403/329

[56] References Cited

UNITED STATES PATENTS

| | | | |
|---|---|---|---|
| 2,263,155 | 11/1941 | Wright | 30/43.92 |
| 3,381,375 | 5/1968 | Baumann | 30/43.92 |

FOREIGN PATENTS OR APPLICATIONS

| | | | |
|---|---|---|---|
| 89,684 | 6/1967 | France | 30/43.92 |
| 1,456,077 | 9/1966 | France | 30/43.92 |
| 1,145,955 | 3/1963 | Germany | 30/346.51 |
| 2,161,810 | 5/1973 | Germany | 30/346.51 |
| 121,639 | 5/1948 | Sweden | 403/329 |

*Primary Examiner*—Gary L. Smith
*Attorney, Agent, or Firm*—Charles R. Miranda

[57] ABSTRACT

A mounting arrangement for securing a flexible foil outer cutter to an electric dry shaver housing in operative relationship relative to a driven inner cutter. The outer cutter foil is arranged within a frame hinged to the upper portion of the shaver casing. The spaced opposite ends of the foil are provided with portions having integral spring detent tabs for detachably locking engagement in slots provided in the frame for securing the foil thereto.

5 Claims, 7 Drawing Figures

Fig. 5.
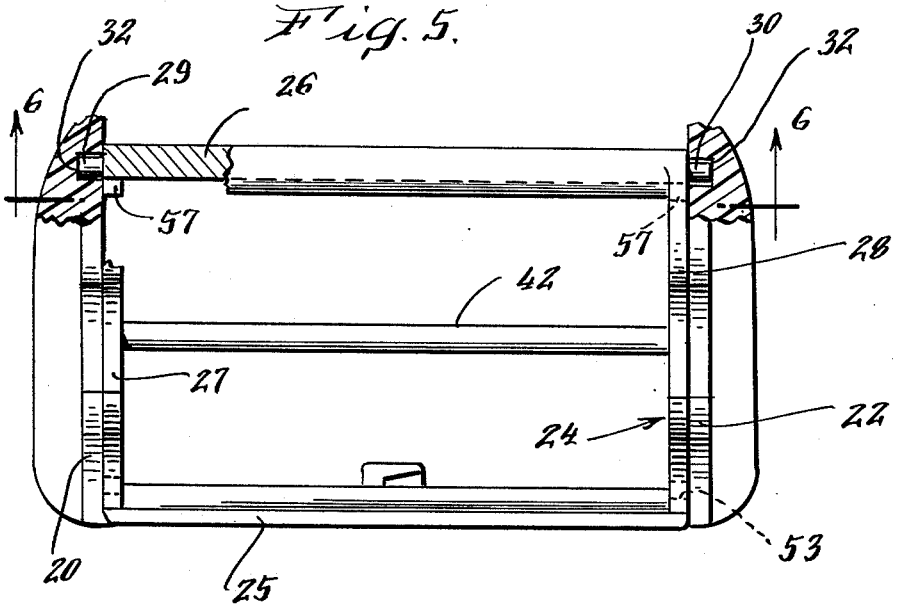
Fig. 6.
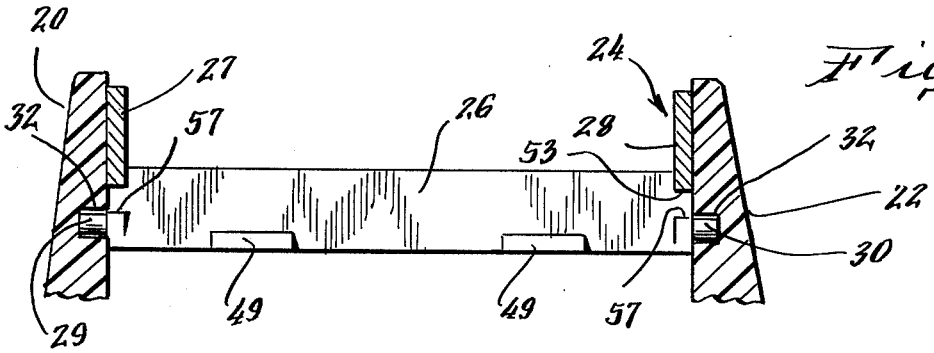
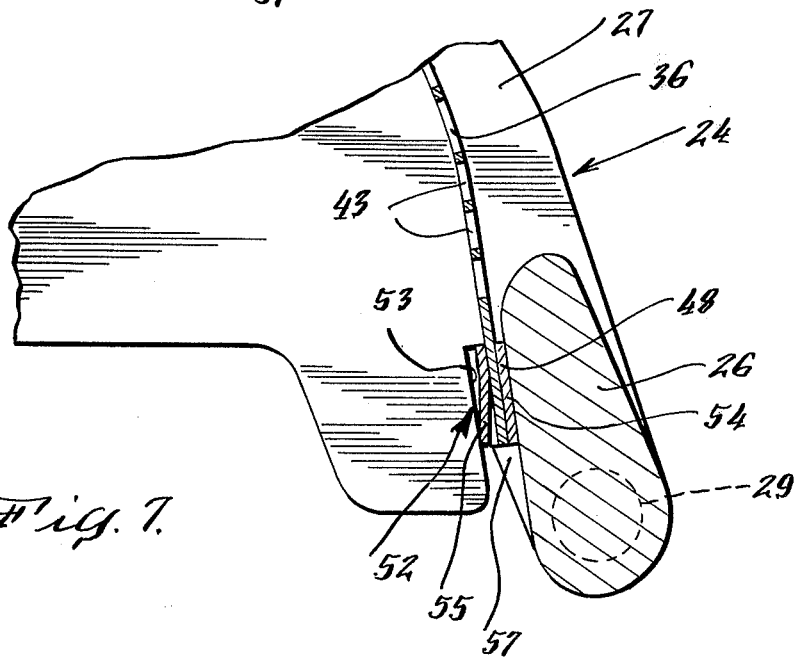
Fig. 7.

ELECTRIC DRY SHAVER HAVING FLEXIBLE FOIL TYPE OUTER CUTTER

BACKGROUND OF THE INVENTION

This invention relates to new and useful improvements in electric dry shavers and in particular to means for mounting an outer cutter foil to the hairpocket of an electric dry shaver casing.

Electric dry shavers which utilize thin resilient plate members such as flexible metallic foils as the outer cutter portions of the cutter head are well-known. In shavers of this type the outer cutter is mounted in an open frame or hairpocket section which is hinged or otherwise detachably secured to the upper portion of the shaver casing. In mounted position on the shaver the foil engages and conforms to the outer configuration of an inner cutter disposed within the shaver. Perforations are provided in the foil through which hair passes for engagement with the inner cutter which is adapted for reciprocating movement relative thereto. It is usual practice in shavers of this type that the foil be held in an arcuate or bowed shaped configuration in conformity to the outer arcuate shape of the inner cutter which comprise a row or rows of spaced arcuate blades. In some shavers of this type therefore the outer cutter comprises either a single bowed portion or in others a plurality of bowed portions for engagement with a like number of inner cutters.

In order to achieve optimum shaving conditions it is desirable that the foil be formed to a minimum thickness as is necessary to cut hair bristles closer to the user's skin without irritation to the user or damage to the foil. It is also critical that the foil be mounted in a manner whereby it will not become accidentally detached from the hairpocket during operation of the shaver and yet include means whereby it can be readily removed for replacement without damage.

In the past various means have been provided for accomplishing these ends. In certain shavers the means have comprised fastening members such as threaded fasteners for holding marginal portions of the foil to the hairpocket. In other shavers openings are provided in marginal portions of the foil or in members secured to the foil for detachably mounting upon lugs or other projections provided on the side walls of the casing. Although these means have met with various success, problems are encountered in use in assuring that the foil does not become detached during operation of the shavers. In some shavers attaching means tend to interfere with adjacent portions of the shaver and require relatively complex parts and assembly procedures.

It is the object of the present invention therefore to provide novel means for mounting a foil type outer cutter to an electric dry shaver casing.

Another object is to provide mounting means which provide means for holding the foil in position without need for complicated forming of parts or complex assembly procedures.

A still further object is to provide a novel mounting means of relatively few and simple parts that does not interfere with other mechanisms in the shaver.

SUMMARY OF THE INVENTION

The present invention contemplates novel means for mounting a foil type outer cutter in an electric dry shaver housing. In one embodiment of the invention the device comprises an outer cutter foil having stiffening bar members secured to spaced end marginal portions thereof. Integral spring tab members extend from the spaced corner portions of the bar for engagement in slots provided in the corners of an open frame hairpocket section of the shaver. An integral spring leg is provided on each tab for locking engagement against the wall of the slot of the frame for securing the foil thereto.

The above and other objects and advantages of the present invention will appear more fully hereinafter from a consideration of the detailed description which follows, taken together with the accompanying drawings where one embodiment of the invention is illustrated.

BRIEF DESCRIPTION OF THE DRAWINGS

In the drawings:

FIG. 5 is a plan view of the outer cutter foil supporting frame;

FIG. 6 is a sectional view taken on the line 6—6 of FIG. 5; and

FIG. 7 is an enlarged view of a portion of the right side of FIG. 4 showing the mounting means for one corner of the cutter foil.

DETAILED DESCRIPTION

Figure 1:
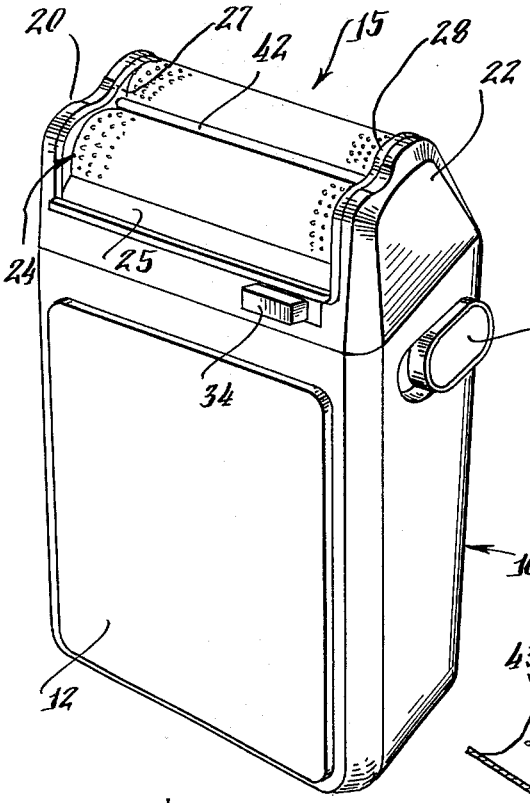
FIG. 1 is a perspective view of an electric dry shaver incorporating the present invention.

Referring now to the drawings for a more detailed description of the present invention, an electric dry shaver incorporating one embodiment thereof is generally indicated by the reference numeral 10 in FIG. 1. Electric dry shaver 10 is of a usual type construction and includes a premolded lower main casing section 12 in which is housed an electric motor (partially shown at 13 in FIG. 4). A drive arm 14 extends from motor 13 for operating a cutter head assembly generally indicated by the reference numeral 15 upon actuation of an on/off switch 16 (FIG. 1) in a usual manner from either an external power outlet or from an internal battery circuit arrangement.

Drive arm 14 (FIG. 4) extends into the hairpocket section 18 of shaver 10 and which hairpocket 18 is formed by end wall pieces 20 and 22 (FIG. 1) extending upwardly from the spaced end walls of main casing section 12. An outer cutter supporting frame 24 is disposed between end wall pieces 20 and 22. Frame 24 comprises spaced sidewalls 25 and 26 and end walls 27 and 28. Frame 24 is hinged to end pieces 20 and 22 in a usual manner such as by pintles 29 and 30 (FIG. 5) provided in the lower corner portions of end walls 27 and 28 located in pivot apertures 32 provided in casing end pieces 20 and 22. Suitable latch means (not shown) are provided in sidewall 25 of frame 24 and main casing section 12 which are operable through release latch 34 to permit frame 24 to pivot upwardly away from drive arm 14 when desired.

Figure 4:
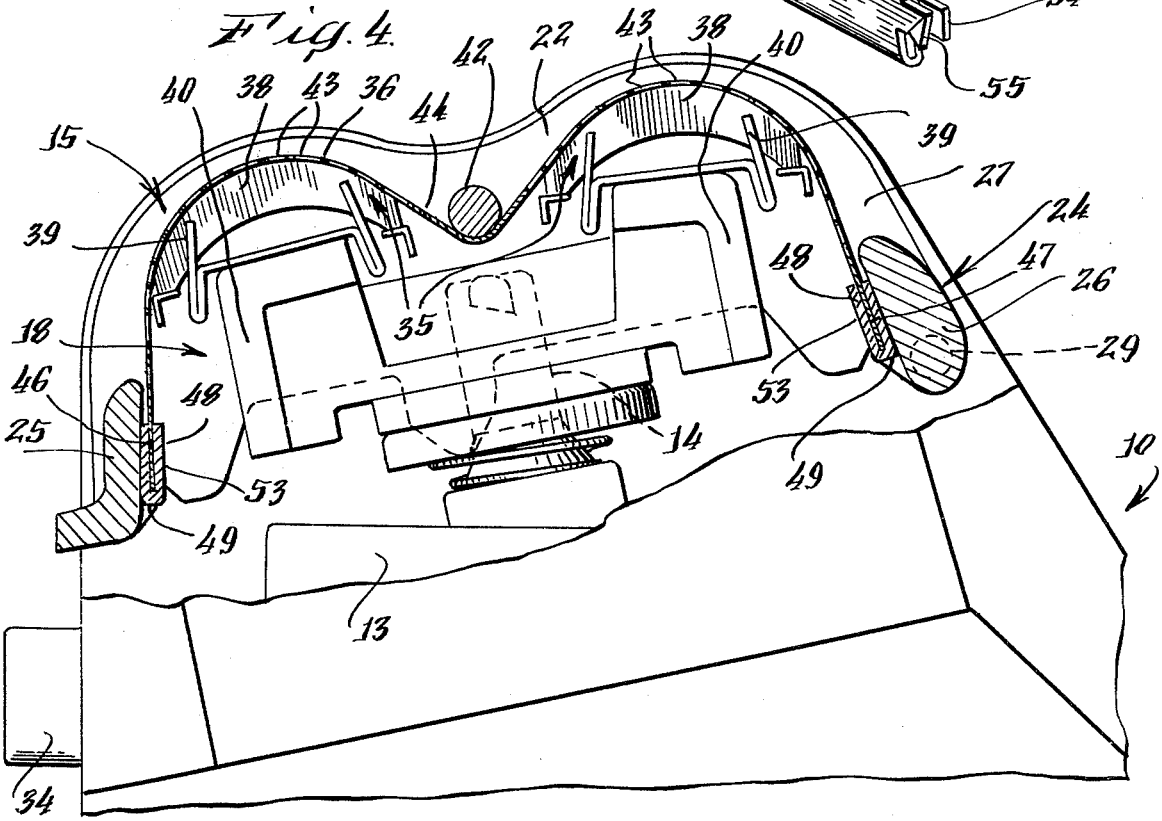
FIG. 4 is a fragmentary cross-sectional end view taken transversely through the upper portion of the shaver of FIG. 1.

As seen in FIG. 4 cutter head assembly 15 includes a movable inner cutter 35 and outer cutter foil 36. Inner cutter 35 includes two parallel rows of arcuate cutter bars 38 supported on frames 39 in a known manner such as for example shown in U.S. Pat. No. 3,858,461 to R. J. Tolmie issued Jan. 7, 1975, entitled "Shaver Inner Cutter." Frames 39 are mounted on a plate 40 which is adapted for movement relative to outer cutter foil 36 by drive arm 14 upon operation of motor 13. In shaver 10 two rows of inner cutter bars 38 are provided for maintaining outer cutter foil 36 in two spaced bowed rows defined by a center bar 42 (FIG. 4) extending between endwalls 27–28 of frame 24.

The structure thus far described represents more or less conventional structure as found in known electric dry shavers. It is to be understood that the present invention is adaptable for use in other type shavers as will hereinafter be clearly understood.

Figure 2:
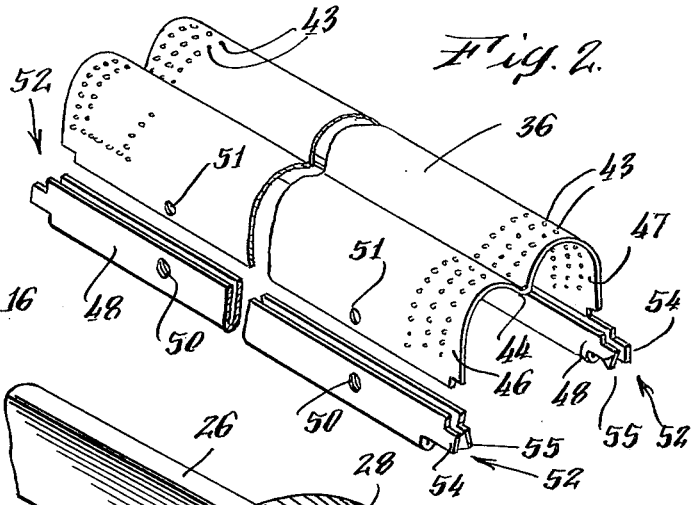
FIG. 2 is a perspective view of the outer cutter foil of the electric dry shaver of FIG. 1 removed therefrom.

As mentioned it is the feature of the present invention to provide novel means for mounting an outer cutter such as outer cutter foil 36 to a shaver. To this end thin metallic foil 36 (FIG. 2) which is preferably formed by a suitable electroforming process is provided with hair reception opening 43 at each side of a central nonperforated portion 44. The spaced lower end marginal portions 46–47 of foil 36 are also imperforate. Stiffening means comprising clamp bars 48 are secured to marginal portions 46 and 47 for strengthening foil 36 and for positioning the same adjacent sidewalls 25 and 26 on abutments 49 of supporting frame 24. Clamp members 48 each comprise a U-shaped metal bar press-fitted to marginal portions 46–47 and having dimples 50 aligned in openings 51 of margins 46–47.

Figure 3:
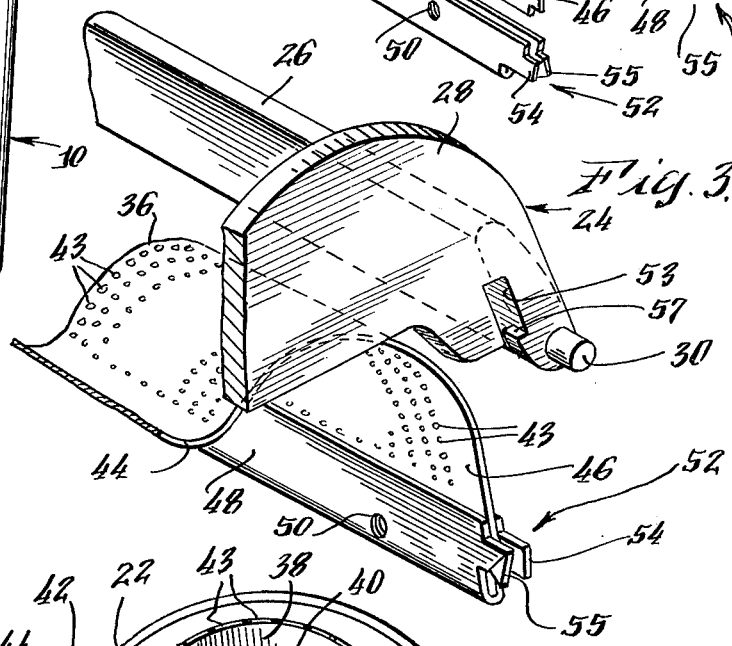
FIG. 3 is a fragmentary exploded end view of the outer cutter foil and supporting frame therefor.

Means for mounting and securing foil 36 to include tab extension portions 52 are provided at the opposite ends of bars 48. Tab extensions 52 are each located in a slot 53 (FIGS. 3 and 7) provided in end walls 27–28 of frame 24. The mounting is the same at each end of bar 48 and in the drawings is shown in detail with respect to one such mounting in FIGS. 3 and 7. Tabs 52 each comprise a pair of front and rear spring legs 54 and 55 respectively. Rear leg 55 is bent slightly to abut against the wall of slot 53 (FIG. 7) while leg 54 is set upon a ledge 55 in slot 53 to detent foil 36 securely in frame 24.

If it is desired to remove foil 36 from frame 24 then with frame 24 either removed from or pivoted from casing 12 a pointed instrument may be inserted into slot 53 to flex legs 54–55 away from the walls of the slot thereby releasing clamps 48 from frame 24.

In order to mount foil 36 in frame 24, frame 24 may be removed from casing 11 moving frame 24 away to a pivoted open position relative to main casing section 12. Foil 36 is then placed in frame 24 and as center bar 42 engages non-perforated central portion 44, tabs 52 are moved into slots 53. As front leg 54 snaps into cut out ledge portion 57 rear bent leg 55 engages against the wall of slot 52 opposite ledge 57 to detent bar 49 in position in frame 24 against accidental dislodgement. Frame 24 is then moved to a closed position on casing 12 and in a usual manner spring urged inner cutter 36 places foil in bowed configuration for shaving operation.

It is apparent from the foregoing description that the novel mounting means for a foil type outer cutter has many advantages in use. One advantage is that the novel mounting means require relatively uncomplexed forming of parts and results in simplified assembly procedures in reduction of parts and labor. Another advantage among others is that the mounting means requires a minimum area of operation within the frame portion without interfering with other internal mechanisms of the shaver.

Although one embodiment of the present invention has been illustrated and described in detail. It is to be specifically understood that the invention is not limited thereto. Various changes can be made in the design and arrangement of parts without departing from the spirit and scope of the invention as the same will now be understood by those skilled in the art.

We claim:

1. An outer cutter assembly for an electric dry shaver comprising, a. a frame member having slots therein, b. a flexible foil outer cutter having oppositely disposed marginal portions, c. elongated U-shaped bars clamped to a pair of said marginal portions for stiffening said pair of marginal portions, d. tabs formed on said bars extending from opposed ends thereof, and e. resilient spaced leg members formed on at least one of said bars and biased against wall portions of said frame member slots for interlocking the foil outer cutter to the frame member.

2. The outer cutter assembly of claim 1 wherein said frame includes spaced sidewalls, and endwalls having said slots disposed therein, said at least one bar being adjacent said sidewalls and said tabs extending into said slots.

3. The outer cutter assembly of claim 1 wherein said slots are provided with cut out ledge portions, one of said spaced leg members in seating engagement with said ledge portion and the other leg member biased against the wall of said slots.

4. The outer cutter assembly of claim 3 wherein the other of said leg members is bent in a direction away from said one leg member to apply a biasing force thereto.

5. The outer cutter assembly of claim 4 wherein said at least one bar is of metallic material and said leg members provide springlike detent means or said foil.

* * * * *